United States Patent [19]

Lord

[11] Patent Number: 4,662,994

[45] Date of Patent: May 5, 1987

[54] LINK BELTS

[75] Inventor: Richard T. G. Lord, Preston, England

[73] Assignee: Scapa-Porritt Limited, Blackburn, England

[21] Appl. No.: 867,002

[22] Filed: May 20, 1986

Related U.S. Application Data

[63] Continuation of Ser. No. 573,721, Jan. 25, 1984, abandoned.

[30] Foreign Application Priority Data

Jan. 26, 1983 [GB] United Kingdom ..... 8302118

[51] Int. Cl.[4] ..... D21F 1/10

[52] U.S. Cl. ..... 162/348; 474/206; 474/207

[58] Field of Search ..... 474/206, 207; 162/348

[56] References Cited

U.S. PATENT DOCUMENTS

| | | | |
|---|---|---|---|
| 3,187,072 | 6/1965 | Morin | 474/207 X |
| 4,345,730 | 8/1982 | Leuvelink | 245/6 |
| 4,481,079 | 11/1984 | Dawes | 162/348 |

FOREIGN PATENT DOCUMENTS 2419751 12/1975 Fed. Rep. of Germany .

*Primary Examiner*—James A. Leppink
*Assistant Examiner*—Frank H. McKenzie, Jr.
*Attorney, Agent, or Firm*—Fleit, Jacobson, Cohn & Price

[57] ABSTRACT

The invention proposes the use, in the manufacture of link belts, of helical coils wound from elongate synthetic plastics material of non-circular, and preferably generally rectangular, transverse cross-section, the major dimension of the said cross-section extending widthwise of the link belt.

By using, for example, flat monofilament yarns of a given cross-section in the production of an oval coil of a related major dimension it is possible to increase the cross-section of the wire receiving tunnel formed by two interdigitated coils without prejudice to the capability of interdigitated coils to remain in mutual engagement, and thus facilitate the introduction of hinge wires by mechanical means.

21 Claims, 3 Drawing Figures

LINK BELTS

This application is a continuation of application Ser. No. 573,721, filed Jan. 25, 1984, now abd.

BACKGROUND OF THE INVENTION

The invention concerns link belts, and has particular, though not exclusive, reference to link belts as used as conveyor or support structures in the papermaking and related industries.

Conventional link belts comprise a combination of coils produced from monofilament yarns of circular cross-section joined in interdigitated disposition by hinge wires engaged with the overlapping turns of adjacent coils. In a link belt typical of one type of structure the coils are of oval cross-section and have a major inside dimension of 3.75 mm, the monofilament yarn and the hinge wire being 0.55 mm and 0.9 mm in diameter respectively. In such a structure, ready insertion of the hinge wires, particularly by mechanical means, requires that adjacent coils, at least in practical terms be fully engaged one with another, any diviation from such full engagement reducing the transverse dimension of the hinge wire receiving tunnel formed by the overlapping turns of adjacent coils and material deviation reducing such transverse dimension to an extent sufficient to prevent or to make difficult the insertion of the hinge wire.

It is known in the art that tension introduced into close wound coils by opening up the turns thereof to receive an adjacent coil into interdigitated relationship therewith and which arises from the elastic properties of the material of the coil assists in maintaining engagement of one coil with another, such tension causing successive turns of one coil to grip the interposed turns of the next adjacent coil and, if of sufficient magnitude, to prevent separation of such coils.

The tension in the coil is a function of the elastic properties of the material of the coil, and is accordingly determined by, inter alia, the cross-sectional dimension of the polyester monofilament which forms the coil, and reduction in such dimensions giving rise to a corresponding reduction in the gripping effect of the turns of one coil on those of another.

Having regard to possible non-uniformity of the physical characteristics of adjacent coils, to the incidence of secondary twist therein or to other factors, full engagement of adjacent coils may not occur or may not be maintained, with the result that difficulty may be experienced in effecting hinge wire insertion.

A reduction in the diameter of the monofilament from which the coils are formed, the major inside diameter of the coil remaining unchanged, allows of an increase in the cross-sectional dimensions of the tunnel formed by over-lapping turns of adjacent spiral coils by increasing the extent of permitted engagement of one coil with an existing array of connected coils, and would thus facilitate hinge wire insertion. However, such reduction in diameter would also reduce the spring tension in the coil, and thus the gripping effect of one coil on the interposed turns of the next adjacent coil, and would accordingly increase the likelihood of coil separation, thus making worse the very problem sought to be avoided by the reduction. Furthermore, too ready a opening up of the turns of the coil might well give rise to separation in excess of that required and result in a plurality of turns of the adjacent coil being engaged between two successive turns of a given coil.

An object of the present invention is to provide a tunnel of increased cross-sectional dimensions without prejudice to the capacity of the coils to remain in interdigitated disposition, thus to avoid the difficulties experienced in the mechanical insertion of hinge wires into the interdigitated turns of adjacent helical coils to connect the same together.

SUMMARY OF THE INVENTION

Thus, according to the present invention there is proposed a link belt comprising a multiplicity of helical coils arranged in interdigitated side-by-side disposition, adjacent coils being connected by respective hinge wires, characterised in that the coils are formed from elongate synthetic plastics material initially of non-circular, constant cross-section and having a major cross-sectional dimension extending in the axial direction of the coil.

According to a preferred feature the elongate material is of flat, generally rectangular cross-section.

According to a further preferred feature the elongate material comprises a monofilament yarn.

The invention is thus predicated upon the appreciation that coils formed from elongate synthetic plastics material of non-circular cross-section make possible the attainment of a like level of spring tension in an oval coil of similar major dimension to that of a coil produced from circular cross-section yarns whilst providing a hinge wire receiving tunnel of increased cross-sectional dimensions, the assembly problems experienced in relation to coils made from circular section yarns thereby being avoided.

DESCRIPTION OF THE PREFERRED EMBODIMENTS

Figure 1:
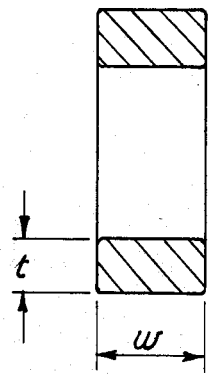
FIG. 1 is a diagrammatic cross-section of a single turn of a coil produced from flat monofilament yarns.
Figure 3:
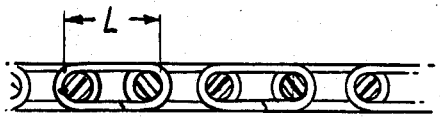
FIG. 3 is a fragmentary diagrammatic side elevation of the link belt shown in FIG. 2.
Figure 2:
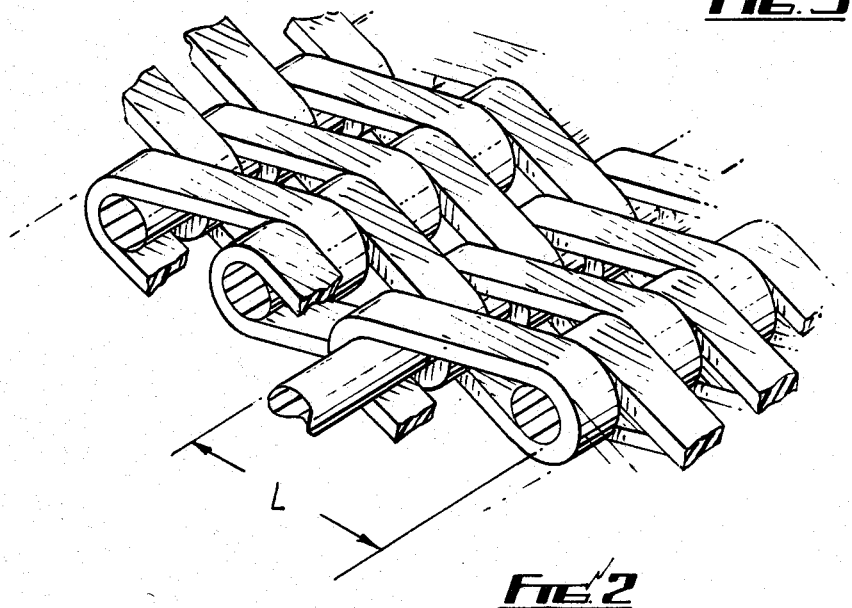
FIG. 2 is fragmentary perspective view of a link belt comprising coils produced from flat monofilament yarn.

Referring now to the drawing, the cross-section of the coil material is illustrated in FIG. 1, with the width of the cross-section identified by w and the thickness of the cross-section identified by t. A plurality of coils formed from such a flat monofilament are illustrated in interdigitated relationship in FIG. 2. As therein shown, the coils are of flattened form and have a major internal dimension designated by L. A side view of the belt viewed along the axes of the respective coils is shown in FIG. 3.

We have found that a coil produced from polyester yarn of non-circular cross-section and satisfying the relationship $10<L/a<24$ or the relationship $$4 < \frac{a^2 \times 10^4}{L^3} < 16,$$

where a is the cross-sectional area of the monofilament yarn and L is the major internal dimension of the coil, has a tension appropriate to the satisfactory mechanical insertion of hinge wires into the interdigitated turns of adjacent coils in the production of papermachine and like clothing.

Whilst it may be that the above ranges for L/a and $(a^2 \times 10^4)/L^3$ will be proper for all synthetic plastics materials likely to be used in the production of monofilaments suitable for application to the context of link belts, it is to be borne in mind that such ranges may require adjustment in certain instances, possibly by reference to the relationship between the modulus of rigidity of polyester and that of the material in question. Investigation suggests that the ratio of major/minor cross-sectional dimensions of the non-circular monofilament yarn should not exceed 3.0, with a preference for the range 1.3 to 2.5, whilst the thickness of the monofilament yarn should be in the range of 0.2 mm to 1.0 mm and preferably between 0.3 and 0.7 mm.

It also appears to be the case that the greater dimension of the non-circular monofilament in the axial direction of the coil will make more practical the use of oval or flat coils of greater major transverse dimension than is possible with circular cross-section yarns, such a course giving rise to a number of important advantages. Thus, for example, a flat coil of 0.7×0.4 mm monofilament exhibits at least as much springiness as one of like composition of circular cross-section and 0.55 mm in diameter, the springiness being proportional to L/a or to $a^2/L^3$ according to the relationship applied. The greater length of the major axis of the flat monofilament, compared with the diameter of the circular cross-section yarn of like cross-sectional area, forces the turns of the coils a like amount further apart when one coil is intermeshed with the adjacent coil with a proportional increase in the spring tension which holds the intermeshed coils together prior to and during the insertion of the hinge wire. The potential increase in spring tension due to the wider material may be utilised by employing a longer (in the sense of major transverse dimension) spiral coil which will allow even greater access space for the hinge wire while having sufficient spring tension to hold the intermeshed coils together.

The increased dimension of the cross-section of the flat monofilament in the axial direction of the coil as compared with the diameter of a circular cross-section monofilament of like cross sectional area and the consequentially greater separation of successive turns of the individual coils on interdigitation does reduce the number of turns per unit of length widthwise of the fabric and makes a significant contribution to a reduction in the weight of the fabric. An increase in major transverse dimension of each flat or oval coil will also give rise to a saving in weight in view of the reduced number of hinge wires and curved portions of coil per unit length of fabric.

It is estimated that a saving in weight of, say, 15% is readily achievable by using flat monofilament and by increasing the major transverse dimension of the coil by, say, 15%, the weight reduction being attributable chiefly to the greater width of the flat monofilament, although the actual weight reduction will vary according to the degree of stretch of the link belt during heat setting under tension.

In addition to the likely saving in cost arising from the reduction in material utilisation, a reduction in the number of coils per unit of fabric length will also be economically advantageous in view of the reduced cost of assembly.

Furthermore, it is the practice, for some applications, to heat set the cloth under tension and then reduce the air permeability by the insertion into the coil channels of filling materials, for example in the form of textured yarns or of tape-like materials, and the time taken, and thus the cost of the filling operation, is reduced by having coils of greater major transverse dimension and hence fewer coils per unit of fabric length.

By way of illustration, the following tables show the values of L/a and $a^2/L^3$ for coils produced from polyester monofilaments of different cross-sectional form and dimension, those structures marked with an asterisk not being practical in the sense of being incapable of satisfactory mechanically assisted assembly into a link belt.

TABLE I

LINK BELT BEFORE HEAT SETTING UNDER TENSION

| Spiral | w mm | t mm | L mm | L $mm^3$ | a $mm^2$ | $a^2$ $mm^4$ | $\frac{L}{a}$ | $\frac{a^2/10^4}{L^3}$ |
|---|---|---|---|---|---|---|---|---|
| 1.1 | 0.7 | | 5.4 | 157 | 0.385 | 0.148 | 14.0 | 9.4 |
| 1.2 | 0.55 | | 5.4 | 157 | 0.238 | 0.057 | 22.7 | 3.6* |
| 1.3 | 0.9 × 0.46 | | 5.4 | 157 | 0.38 | 0.144 | 14.2 | 9.2 |
| 2.1 | 0.55 | | 3.75 | 52.7 | 0.238 | 0.057 | 15.8 | 10.8 |
| 2.2 | 0.4 | | 3.75 | 52.7 | 0.125 | 0.016 | 30.0 | 3.0* |
| 2.3 | 0.7 × 0.4 | | 3.75 | 52.7 | 0.25 | 0.063 | 15.0 | 11.9 |
| 3.1 | 0.7 × 0.4 | | 4.5 | 91.1 | 0.25 | 0.063 | 18.0 | 6.9 |

Where L = major internal dimension of coil
t = minor dimension (thickness) of non-circular coil material
w = major dimension (width) of coil material (diameter if circular)
a = cross-sectional area of coil material

TABLE II

LINK BELT AFTER HEAT SETTING

| Spiral | w mm | t mm | Lf mm | $Lf^3$ $mm^3$ | a $mm^2$ | $a^2$ $mm^4$ | $\frac{Lf}{a}$ | $\frac{a^2 \times 10^4}{Lf^3}$ |
|---|---|---|---|---|---|---|---|---|
| 1.1 | 0.7 | | 5.8 | 195 | 0.385 | 0.148 | 15.1 | 7.6 |
| 1.2 | 0.55 | | 5.8 | 195 | 0.238 | 0.057 | 24.4 | 2.9* |
| 1.3 | 0.9 × 0.46 | | 5.8 | 195 | 0.38 | 0.144 | 15.3 | 7.4 |
| 2.1 | 0.55 | | 4.3 | 79.5 | 0.238 | 0.507 | 18.1 | 7.2 |
| 2.2 | 0.4 | | 4.3 | 79.5 | 0.125 | 0.016 | 34.4 | 2.0* |
| 2.3 | 0.7 × 0.4 | | 4.1 | 68.9 | 0.25 | 0.063 | 16.4 | 9.1 |
| 3.1 | 0.7 × 0.4 | | 4.9 | 118 | 0.25 | 0.063 | 19.6 | 5.3 |

Where Lf = major internal dimension of the coil
t = minor dimension (thickness) of non-circular coil material.
w = major dimension (width) of coil material (diameter if circular)
a = cross-sectional area of coil material.

Link belts constructed from coils of non-circular section material, and particularly from material of approximately rectangular shaped cross-section, also present a greater contact area on their surface than link belts made from circular section materials. The increased contact area can be advantageous in applications requiring a smoother surface or more regular pressure points than presented by normal link belts. For example, the link belts embodying the invention could be used with advantage on the drying section of a paper-making or like machine, a link belt comprising coils made from monofilaments of circular cross-section and used to hold the moist web of paper in contact with the heated drying cylinders conceivably giving rise to marking of the web of paper whereas the flatter spirals hereinproposed would not only be less likely to give rise to marking but the more intimate contact with the drying cylinders could be expected to give an improvement in heat transmission and hence a more rapid and economical drying of the paper web. A further advantage will arise on fast running papermaking machines, in that the smoother surface will carry less boundary air and will thus be less likely to cause turbulence and possible fracture of the paper web.

It is to be observed that in forming a helical coil by winding a monofilament yarn of synthetic plastics material onto a mandrel the material may be deformed slightly at the ends of the major dimension of the coil cross section, the deformation being less in the case of coils wound from yarns of non-circular cross-section. Tests have shown that such latter coils exhibit a significantly lesser tendency to fibrillation in hydrolysis conditions than do comparable coils produced from circular cross-section yarns, although it has not been established whether any relationship exists between deformation and fibrillation. The reduced tendency to fibrillation apparent in the case of coils produced from yarns of non-circular cross-section results in a link belt of significantly improved resistance to belt breakage as compared with belts comprising coils wound from monofilament yarns of circular cross-section, thus giving a further benefit from the use of elongate synthetic plastics material of non-circular cross-section.

It is to be understood that, although specific mention has hereinbefore been made only of monofilament yarns, such expression is intended to include within its scope such as a resin treated multifilament yarn of equivalent or like characteristics and is, wherever the context so permits, to be construed accordingly. Indeed, the invention also includes any elongate synthetic plastics material of non-circular cross-section which comprises a core of circular or non-circular cross-section and a sheath or cover, say of polyamide, applied thereto.

I claim:

1. A link belt comprising a multiplicity of helical coils arranged in interdigitated side-by-side disposition; respective hinge wires connecting successive side-by-side coils; the coils being formed from elongate synthetic plastics material and being of non-circular transverse cross-section with a major internal dimension existing generally in the plane of the link belt; the elongate synthetic plastics material initially being of non-circular, constant transverse cross-section and having a major transverse cross-sectional dimension extending in the axial direction of the coil; and the coils satisfying the relationship $10<L/a<24$ where a is the transverse cross-sectional area of the elongate material and L is the major internal dimension of the coil.

2. A link belt as claimed in claim 1, wherein the elongate material is of flat, generally rectangular cross-section.

3. A link belt as claimed in claim 1, wherein the elongate material comprises a monofilament yarn.

4. A link belt as claimed in claim 1, wherein the elongate material comprises a resin treated multifilament yarn.

5. A link belt as claimed in claim 1, wherein the elongate plastics material comprises a polyester yarn.

6. A link belt comprising a multiplicity of helical coils arranged in interdigitated side-by-side disposition; respective hinge wires connecting successive side-by-side coils; the coils being formed from elongate synthetic plastics material and being of non-circular, transverse cross-section with a major internal dimension existing generally in the plane of the link belt; the elongate synthetic plastics material initially being of non-circular, constant transverse cross-section and having a major transverse cross-sectional dimension extending in the axis direction of the coil; and the coils satisfying the relationship $$4 < \frac{a^2 \times 10^4}{L^3} < 16,$$

wherein a is the cross-sectional area of the elongate material and L is the major internal dimension of the coil.

7. A link belt as claimed in claim 1, wherein the ratio of the major/minor cross-sectional dimensions of the elongate material is not more than 3.

8. A link belt as claimed in claim 7, wherein the ratio of the major/minor cross-sectional dimensions of the elongate material lies in the range 1.3 to 2.5.

9. A link belt as claimed in claim 1, wherein the thickness of the elongate element lies in the range 0.2 mm to 1.0 mm.

10. A link belt as claimed in claim 1, wherein the thickness of the elongate element lies in the range of 0.3 mm to 0.7 mm.

11. A link belt as claimed in claim 1, wherein the elongate material comprises a core having a sheath or cover applied thereto.

12. A link belt as claimed in claim 11, wherein the core is of circular cross-section.

13. A link belt as claimed in claim 11 wherein the core comprises a polyester and the sheath or cover comprises a polyamide.

14. A link belt as claimed in claim 6, wherein the ratio of the major/minor cross-sectional dimensions of the elongate material is not more than 3.

15. A link belt as claimed in claim 6, wherein the thickness of the elongate element lies in the range 0.2 mm to 1.0 mm.

16. A link belt as claimed in claim 6, wherein the thickness of the elongate element lies in the range of 0.3 mm to 0.7 mm.

17. A link belt as claimed in claim 6, wherein the elongate material comprises a core having a sheath or cover applied thereto.

18. A link belt as claimed in claim 17, wherein the core is of circular cross-section.

19. A link belt as claimed in claim 17, wherein the core comprises a polyester and the sheath or cover comprises a polyamide.

20. A link belt as claimed in claim 18, wherein the core comprises a polyester and the sheath or cover comprises a polyamide.

21. A link belt comprising a multiplicity of non-circular helical coils arranged in interdigitated side-by-side disposition; respective hinge wires connecting successive side-by-side coils; the coils being formed from elongate synthetic plastics material and being of flat, substantially rectangular transverse cross-section with a major internal dimension extending generally parallel to the plane of the link belt; the elongate synthetic plastics coil material having a thickness in the range of from about 0.3 mm to about 0.7 mm and being of constant transverse cross-section, said coil material having a ratio of the major cross-sectional dimension to the minor cross-sectional dimension in the range of from about 1.3 mm to about 2.5 mm; and the coils satisfying the relationship $$4 < \frac{a^2 \times 10^4}{L^3} < 16,$$

wherein a is the cross-sectional area of the elongate material and L is the major internal dimension of the coil.

* * * * *